United States Patent [19]

Tindall

[11] Patent Number: 4,758,032

[45] Date of Patent: Jul. 19, 1988

[54] WINDOW LATCH

[75] Inventor: Gary W. Tindall, Hazel Green, Wis.

[73] Assignee: Deere & Company, Moline, Ill.

[21] Appl. No.: 933,432

[22] Filed: Nov. 10, 1986

[51] Int. Cl.[4] ..... E05C 17/14

[52] U.S. Cl. ..... 292/265; 292/218

[58] Field of Search ..... 292/218, 262, 116, 120, 292/38, 91, 17, 291, 240, 107, 265, 275, DIG. 6, DIG. 38

[56] References Cited

U.S. PATENT DOCUMENTS

| | | | |
|---|---|---|---|
| 1,836,611 | 12/1931 | Meyer | 292/265 X |
| 2,196,478 | 4/1940 | Simpson | 292/DIG. 5 |
| 2,422,114 | 6/1947 | Matter | 292/241 X |
| 3,620,483 | 11/1971 | Weinberger | 292/262 |

FOREIGN PATENT DOCUMENTS

| | | | |
|---|---|---|---|
| 2940812 | 4/1981 | Fed. Rep. of Germany | 292/265 |
| 292896 | 2/1932 | Italy | 292/265 |
| 859583 | 1/1961 | United Kingdom | 292/265 |

*Primary Examiner*—Richard E. Moore

[57] ABSTRACT

A window latch that includes a latch plate swingably mounted on the window and having edge notches facing a latch rod. The rod may be inserted in one notch for locking the window in a closed position. The other of the notches are keyhole shaped and the throat is smaller than the rod but will expand sufficiently to permit movement of the rod into and out of the respective notch.

6 Claims, 1 Drawing Sheet

Fig. 1
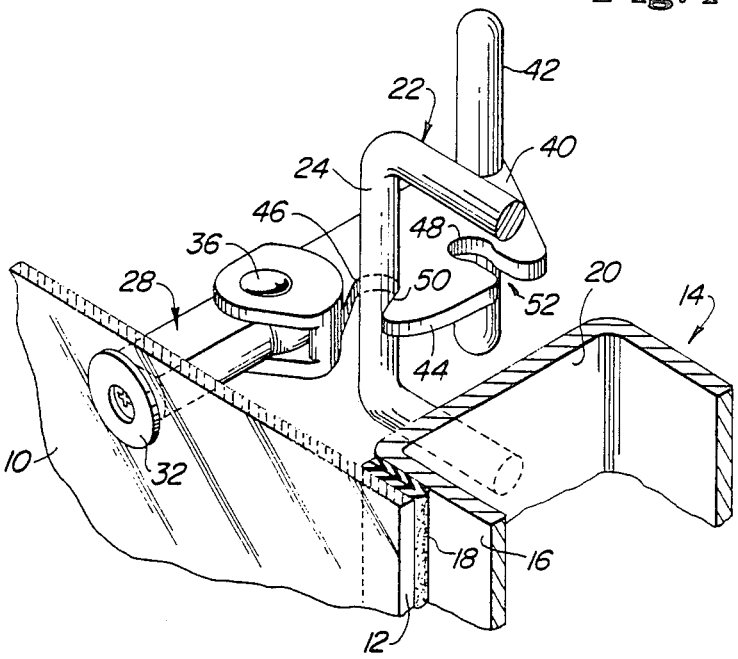
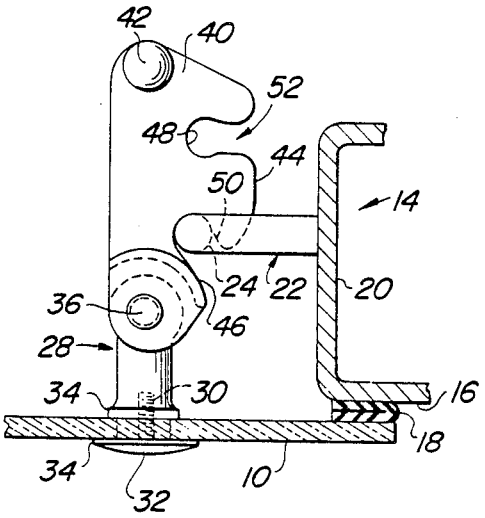
Fig. 2
Fig. 3
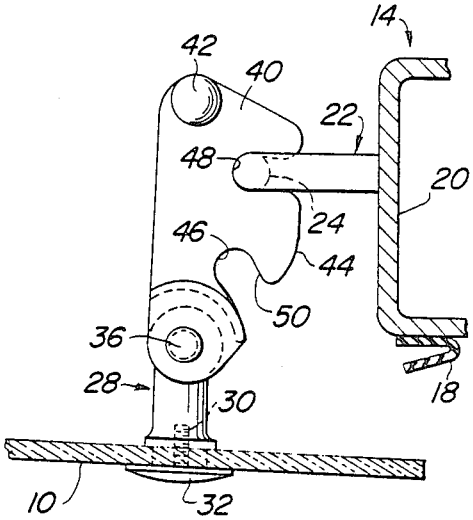

WINDOW LATCH

BACKGROUND OF THE INVENTION

Modern day cabs on tractors and other equipment have both heating and air conditioning systems that require the windows on the cabs to be sealed while the air conditioning and heating units are being used. Generally, there is a weather seal provided between the edge of the window and the surrounding frame work of the cab which prevents air leakage. However, in some instances, due to climatic and temperature conditions, it will be desired to open the window a small amount. Also, in some instances, it will be desirable to have the window slightly open so that the operator within the cab can converse with a party or parties on the ground. Consequently, the conventional-type window latch, which provides for either a completely closed or a completely opened window, has been found to be unsatisfactory.

In some instances, it has become necessary to provide different type of linkages or latch structures for holding the window in a desired opened position. However, since cabs are generally crowded with controls and other structure, there may be room restrictions preventing the use of additional structure utilized to hold the window in a partially opened position. Also, there is the additional expense in providing this additional structure.

With the above in mind, it is the primary purpose of the present invention to incorporate in the latch that holds the window in a closed position, additional features which permit the same latch to hold the window in a slightly opened position. More specifically, it is the primary purpose of the present invention to provide a latch plate that is mounted on the window and has notches spaced along its edge. The notches are positioned to receive a latch rod on the post. One notch on the latch plate will lock or latch the window in a completely closed position. The other of the notches will receive the latch rod, but will retain the window in a partially opened position. In either position, the latch rod is held in the respective notches through the characteristics of the latch plate or the shape of the notches in the latch plate. Thus, a single latch plate may be utilized to both retain the window in a closed position as well as to retain it in a slightly opened position.

BRIEF DESCRIPTION OF THE DRAWINGS

FIG. 1 is a perspective view, partially in section, showing a frame post, a portion of the window and the latch structure which retains the window in the desired position.

FIG. 2 is a vertical, sectional view showing the frame post and window and the latch structure in a position that seals the window against the frame structure.

FIG. 3 is a view similar to FIG. 2, but showing the latch structure holding the window in a slightly opened position.

DESCRIPTION OF THE PREFERRED EMBODIMENT

Referring now to the drawings, a vertical window 10 of tempered glass is provided as a closure for a window opening in one side of a tractor cab. The window 10 is hinged (not shown,) at its forward edge to a part of the tractor frame structure which forms the opening. The opposite edge portion 12 bears against a part of the frame structure which is a vertical post 14. The vertical post 14 is a U-shaped channel and has a vertical leg portion 16 that is positioned opposite the edge portion 12 of the window 10.

A U-shaped rubber seal 18 is provided between the edge portions of the window 10 and the frame structure 14 that forms the opening for the window. While only a part of the seal 18 and the frame post structure 14 is shown, the remainder of the frame structure and its seal 18 is of conventional nature and it is believed that further detail is not necessary for purposes of understanding the present invention.

Welded to the bight portion 20 of the post 14 and extending inwardly behind the window 10 is an upright U-shaped latch element 22 that has the upper and lower horizontal legs welded to the vertical portion 20 of the post 14. The latch element 22 includes a vertical portion 24 that is parallel to the post 14 and also to the window 10.

A latch mounting bracket 28 is mounted on and projects inwardly from the window 10. The bracket 28 is composed of two parts, the main part having a threaded section 30 that extends through the window pane 10 and receives a matching internally threaded head end 32. Suitable seals, such as at 34, are provided between the glass of the window 10 and the respective surfaces of the mounting bracket 28. The innermost end of the mounting bracket 28 carries a vertical pivot pin 36 that is both parallel to the latch rod 24 and the window 10.

Mounted on the vertical pin 36 is a latch plate 40. The latch plate 40 is composed of a hard plastic material and has integral therewith a vertical handle 42 that has portions thereof extending above and below the plate 40. The plate 40 has an edge 44 facing the rod portion 24 and the post 14. The edge contains notches 46, 48. The notch 46 is adjacent the vertical pin 36 and the notch 48 is spaced further from the pin 36. As is clearly apparent, the notches 46, 48 are for purposes of receiving the latch rod portion 24. The notch 46 opens toward the window 10 and has a cam edge 50 that extends from the notch entry area to the base of the notch 46. When it is desired to close the window, the operator uses the handle 42 to swing the latch plate inwardly with respect to the post 20 until the outermost end of the cam edge 50 engages the rod or latch portion 24. The handle 42 is then pushed towards the post 14 and the latch rod 24 moves along the cam edge 50 to the base of the notch 46. At the same time, the edge portion of the glass adjacent the edge 12 compresses the weather seal 18. Such compression creates or series as a biasing force tending to separate the window 10 from the post 20. However, the latch portion 24 is trapped in the notch 46 and the latch plate 40 is then positioned to resist the force. Thus, the window 10 is held in its closed position. When it is desired to open the window or disengage the latch, handle 42 is pulled in a direction away from the post 20 and the window 10 is forced away from the seal 18.

The second notch 48 is a keyhole shaped notch having a comparatively narrow throat 52 which is smaller than the outside dimension of the latch rod portion 24. When it is desired to hold the window 10 in a slightly opened position, as shown in FIG. 3, the handle 42 is moved toward the post 14 and the latch portion 24 is forced through the throat 52 to seat in the base of the notch 48. The latch plate 40, being of a plastic or resilient material, will permit the throat 52 to expand sufficiently to permit the rod portion 24 to move through the throat. However, once seated in the base of the notch 48, the throat will tend to resist dislodgment of the rod portion 24 from the notch 48. Also, there is no weight or force tending to separate the latch rod 24 from the notch 48 and consequently, it will retain in a seated position in the notch 48 until the handle 45 is utilized to pull the latch plate 40 clear of the rod portion 24.

While only one notch 48 is provided, it is clearly apparent that there could be a plurality of notches which would position the window 10 at different open positions by merely expanding the length of the latch plate 40 and cutting the keyhole notches as desired. However, in most instances, it is only desirable to open the window 10 a slight amount for ventilation and/or prevention of condensation within the cab. It should be understood that the window can be opened entirely if such is desired, or it can be placed in a completely closed position. The present latch adds the additional feature of latching it in the slightly opened position.

What is claimed:

1. A window latch structure holding a window pivotally mounted on a frame structure in a plurality of positions, one of which is in a closed postiion; comprising: a biasing means between the window and frame structure effecting a force tending to separate the window from the frame structure when the window is in its closed position; a latch rod parallel to said window, said rod being spaced from and fixed to a portion of frame structure adjacent the window; a latch mounting bracket fixed to and extending inwardly of the window, said bracket having a pivot parallel to the window and the latch rod; a latch plate mounted on the pivot to swing toward and away from the latch rod and having an edge facing the rod, said edge having a pair of rod-receiving notches therealong with one notch being adjacent the pivot and opening toward the window so that the rod may seat and be held in the notch by said biasing means upon the window being in a closed position, the other of said notches being spaced from said one notch, said other of said notches being keyhole shaped and having an entry portion smaller than the rod so that as said other notch receives said rod, the entry portion may expand to provide entry of but close sufficiently behind the rod to hold the rod in said other notch.

2. The invention defined in claim 1 in which the peripheral portions of the window press against the frame structure at said peripheral portions and a resilient seal is positioned between the frame structure and peripheral portions and is compressed when said rod is seated in the notch opening to the window to thereby provide the aforesaid biasing means.

3. The invention defined in claim 1 further characterized by handle elements rigid with the latch plate and extending to opposite sides respectively of said latch plate.

4. A window latch structure holding a window pivotally mounted on a frame structure in a plurality of positions, one of which is a closed position, comprising: a biasing means between the window and frame structure effecting a force tending to separate the window from the frame structure when the window is in its closed position; a latch rod parallel to the window and fixed to a portion of frame structure adjacent the window; a latch mounting bracket fixed to and extending inwardly of the window, said bracket having a pivot parallel to the latch rod; a latch plate mounted on the pivot to swing toward and away from the latch rod and having an edge facing the rod, said edge having a plurality of rod-receiving notches therealong with one notch being adjacent the pivot and having a mouth opening toward the window so that the rod may seat and be held in the notch by said biasing means upon the window being in a closed position, the other of said notches being keyhole shaped with an entry portion smaller than the rod so that as said other of said notches receives said rod the entry portion may expand to provide entry of but close sufficiently behind the rod to hold the rod in the respective notch.

5. A window latch structure holding a pivotally mounted window in a plurality of positions on a post adjacent the edge of the window, comprising: a latch rod parallel to the window and fixed to the post adjacent the edge of the window; a resilient seal between said edge of the window and the post and effective upon the closing of said window to create a biasing force in a direction tending to separate said window from said post; a latch mounting bracket fixed to and extending inwardly of the window, said bracket having a pivot parallel to the latch rod; a latch plate mounted on the pivot to swing toward and away from the latch rod and having an edge facing the rod, said edge having a plurality of rod-receiving notches therealong with one notch being adjacent the pivot and opening toward the window so that the latch plate may be swung to a position in which the rod is seated in the notch, said notch opening toward the window having a cam edge thereon that upon swinging of said plate to seat the latch rod in the notch, said plate cooperates with the rod and pivot to generate a high closure force to compress said resilient seal, each of the other of said notches being spaced from said one notch at a greater distance from the window, each of said other of said notches being keyhole shaped and having an entry portion smaller than the rod so that as said other of said notches receives said rod the entry portion may expand to provide entry of but close sufficiently behind the rod to hold the rod in the respective notch.

6. The invention defined in claim 5 in which the latch plate is composed of plastic and further characterized by a handle projecting outwardly from the plane of the latch plate.

* * * * *